US009945197B2

(12) United States Patent
Robertson et al.

(10) Patent No.: US 9,945,197 B2
(45) **Date of Patent: *Apr. 17, 2018**

(54) TOOL POSITIONING AND LATCHING SYSTEM

(71) Applicants: Michael C. Robertson, Burleson, TX (US); William F. Boelte, New Iberia, LA (US); Douglas J. Streibich, Fort Worth, TX (US)

(72) Inventors: Michael C. Robertson, Burleson, TX (US); William F. Boelte, New Iberia, LA (US); Douglas J. Streibich, Fort Worth, TX (US)

(73) Assignee: Robertson Intellectual Properties, LLC, Arlington, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/237,438

(22) Filed: Aug. 15, 2016

(65) Prior Publication Data

US 2016/0348453 A1 Dec. 1, 2016

Related U.S. Application Data

(63) Continuation of application No. 14/143,534, filed on Dec. 30, 2013, now Pat. No. 9,416,609, which is a (Continued)

(51) Int. Cl.
*E21B 23/02* (2006.01)
*E21B 29/00* (2006.01)
(Continued)

(52) U.S. Cl.
CPC ..... *E21B 23/02* (2013.01); *E21B 10/32* (2013.01); *E21B 29/00* (2013.01); *E21B 29/005* (2013.01);
(Continued)

(58) Field of Classification Search
CPC ..... E21B 17/14; E21B 10/26; E21B 10/55; E21B 7/20; E21B 17/07; E21B 21/103;
(Continued)

(56) References Cited

U.S. PATENT DOCUMENTS 2,204,091 A 6/1940 Lowrey
2,862,564 A 12/1958 Bostock
(Continued)

*Primary Examiner* — Zakiya W Bates

(57) ABSTRACT

A system and method for positioning a tool within a tubular segment or a tubular tool, wherein the interior surface of the tubular segment or tubular tool is provided with one or more pluralities of grooves, each defining a selected profile. A downhole tool is lowered into the tubular segment or tubular tool, having a blade in communication therewith. The blade includes a plurality of protruding members thereon, which define a profile complementary to one of the selected profiles formed by one of the pluralities of grooves. A biasing member biases the blade toward the interior surface of the tubular segment or tubular tool to engage the protruding members of the blade within the complementary profile of the tubular segment or the tubular tool. The system and method further include a slip and wedge assembly usable to position a tubular segment or tubular tool within a tubular member or wellbore.

24 Claims, 7 Drawing Sheets

Related U.S. Application Data continuation-in-part of application No. 12/625,179, filed on Nov. 24, 2009, now Pat. No. 8,616,293, and a continuation-in-part of application No. 13/507,732, filed on Jul. 24, 2012.

(60) Provisional application No. 61/572,920, filed on Jul. 25, 2011.

(51) Int. Cl.

| | |
|---|---|
| ***E21B 10/32*** | (2006.01) |
| ***E21B 33/12*** | (2006.01) |
| ***E21B 34/06*** | (2006.01) |
| ***E21B 43/12*** | (2006.01) |
| *E21B 34/00* | (2006.01) |

(52) U.S. Cl.

CPC ..... *E21B 33/12* (2013.01); *E21B 34/06* (2013.01); *E21B 43/123* (2013.01); *E21B 2034/002* (2013.01); *E21B 2034/005* (2013.01)

(58) Field of Classification Search

CPC .. E21B 23/006; E21B 2034/002; E21B 23/02; E21B 29/005; E21B 29/06; E21B 33/14; E21B 17/1014; E21B 10/32; E21B 17/1078

See application file for complete search history.

(56) References Cited

U.S. PATENT DOCUMENTS

| | | | | |
|---|---|---|---|---|
| 3,344,862 | A | 10/1967 | Conrad | |
| 4,369,840 | A | 1/1983 | Szarka et al. | |
| 4,510,995 | A | 4/1985 | Krause, Jr. et al. | |
| 4,570,707 | A | 2/1986 | Setterberg, Jr. | |
| 6,012,527 | A | 1/2000 | Nitis et al. | |
| 6,199,632 | B1 | 3/2001 | Shy | |
| 6,761,217 | B1 | 7/2004 | McGarian | |
| 6,929,063 | B2 | 8/2005 | Reese et al. | |
| 2003/0173089 | A1 | 9/2003 | Westgard et al. | |
| 2011/0220357 | A1* | 9/2011 | Segura | E21B 29/002 166/298 |
| 2012/0186823 | A1* | 7/2012 | Xu | E21B 29/005 166/373 |

* cited by examiner

TOOL POSITIONING AND LATCHING SYSTEM

CROSS-REFERENCE TO RELATED APPLICATIONS

This application is a continuation application of, and claims priority to, the pending U.S. patent application having Ser. No. 14/143,534, filed on Dec. 30, 2013, and having the title of "Tool Positioning And Latching System", which is a continuation-in-part of, and claims priority to, the U.S. patent application having Ser. No. 12/625,179, filed on Nov. 24, 2009, having the title of "Tool Positioning And Latching System" and the U.S. patent application having Ser. No. 13/507,732, filed on Jul. 24, 2012, having the title of "Permanent Or Removable Positioning Apparatus And Method For Downhole Tool Operations", which claims priority to the U.S. provisional application having Ser. No. 61/572,920, filed on Jul. 25, 2011. Each of the above-referenced applications is incorporated by reference herein in their entireties.

FIELD

The present invention relates, generally, to systems and methods usable to position a tool within a tubular member or a tubular string at a selected location, enabling precise actuation of the tool on or within a desired region of a tubular string. The present invention further relates to downhole wellbore positioning apparatus and methods whose deployment is a secondary process to an initial construction feature further able to function with or without up-hole operator control.

BACKGROUND

A need exists, in the oil and gas industry, for the ability to anchor, clock in direction, and eventually release a transient tool string that will allow for precise and effective tool system performance. Enabling the precise location of a force, torque, sensor, perforation, drilling exit or other application, at an optimal position, further reduces the requirement to reposition multiple-run, single location tool processes while reducing the chances of misguided or off-position deployments.

During conventional well construction and other downhole operations, components utilized in such processes often become stuck. Conventionally, when this occurs, the stuck component must be freed or removed to resume well operations. In other instances, a downhole component that has reached its design life limits must be removed from service. Conventional apparatus and methods provide limited choices of techniques useful to wholly or partially free or remove such equipment, many of which involve cutting or otherwise perforating a component to remove at least a portion of the string and/or any attached tools from the wellbore.

Some existing tool systems, deployed within a wellbore, are constructed with control lines surrounding the periphery of a pipe. Removal of the pipe requires cutting both the target pipe and the control line(s) for further completion operations to occur. Having the ability to make precise, multiple cuts at a single target plane can enable both elements to be cut; however, such operations are restricted to cutting without causing harm to the backside infrastructure. Thus, placing tools that enable precise energy delivery for cut effectiveness is preferred.

Drilling equipment requires use of heavy-walled tubular members, having small inner diameters, which limits the amount of working space within a tubular string. Therefore, when cutting or otherwise attempting to remove these heavy-walled tubular components, the effectiveness of conventional cutting and removal tools is limited due to the small size of such components necessary for insertion into the tubular string. When stacking multiple cutting or perforating events on the exact location of previous useful work, additive or compounding benefits are realized.

Tubular strings include numerous joints, used to connect lengths of drill pipe, drill collars, bits, steering devices, sensors, mandrels, expandable packers, and other tools and tubular components. To maximize the effectiveness of a cutting device, it is desirable to position a tool directly over a joint between tubular segments. Joints within a drill string typically include male (pin thread) and female (box thread) ends, resulting in a thinner section profile at the cut location. When cutting a tubular string where a torqued joint is present, those torque forces are released. The reduction in tensile force at the joint allows the tubular segments to be readily pulled apart, enabling retrieval of the upper portion of the tubular string.

When screwed together and properly torqued, joints within a tubular string become relatively seamless, thus difficult to locate using conventional well logging devices. While casing collar locators and similar devices are usable to assist in positioning a tool within a tubular string, existing devices are limited in their accuracy, and are generally accurate to within a number of feet. A joint target within a tubular string may be inches in length, requiring far more precise placement of a tool than what is conventionally available using collar locators and similar devices.

Completion processes taking place within a wellbore often require placing sensors, perforating a wall for communication, and perforating a casing such that contact with a geological feature is made. Operations, such as gauge integration, cement squeezing, fracturing and jet drilling, become subsequent processes.

Other positioning systems can include providing physical features within the interior of a tubular string that interact with corresponding physical features of a locating tool; however, these positioning systems require numerous precisely crafted features to ensure proper function and interaction, including various moving parts to cause selective engagement between corresponding features.

A need exists for removable positioning apparatus and methods for positioning a tool with complementary mating integration capacity within a tubular string, for enabling precise positioning of anchorable tools at a preselected location, including joints within the tubular string, to facilitate the effectiveness of tools. Having the flexibility of a selectively placed locking feature within a tubular member greatly reduces the size of the apparatus necessary to positively fixate a tool using pre-positioned anchoring profile mechanisms within a wellbore system.

A further need exists for positioning apparatus and methods usable for positioning a tool within a tubular string that are simple in construction and function, able to incorporate reusable, machinable, and re-machinable parts, and able to accommodate a variety of latching and/or engaging orientations.

A need also exists for positioning apparatus and methods usable for positioning a tool within a tubular string that are conveyable and deployable utilizing readily available setting tools.

A need also exists for systems and methods for positioning a tool within a tubular string that are pre-tensioned and directionally biased, able to selectively engage and disengage from selected locations.

A need also exists for systems and methods usable for precise positioning of a downhole tool within a tubular string, such that the downhole tool can be selectively engaged and cut, perforated, and/or disengaged from the selected location.

The present invention meets these needs.

SUMMARY

The present invention relates, generally, to a system usable to position a tool within a wellbore. A section of the interior of a tubular string, which can include any type of casing string, tubing string, drill string or work string, or other type of conduit formed from multiple connected tubular segments, is provided with a plurality of grooves. The grooves can be disposed in a separate sub or other tubular member or element, or the grooves can be provided to a standard tubular member or segment used within a tubular string.

The grooves define a selected profile, intended to lock with a complementary profile disposed in association with a tool to be positioned. The selected profile can be defined by the spacing between the grooves, the depth of the grooves, the interior shape of the grooves, or other similar features usable to differentiate the selected profile from other features or profiles within the tubular string. In an embodiment of the invention, the selected profile can be shaped to permit downward movement of a complementary profile into engagement, while preventing upward movement, such as through use of an upwardly facing no-go shoulder, or a similar element within the selected profile and/or the complementary profile.

In a further embodiment of the invention, one or more tubular segments of the tubular string can be provided with standard sets of grooves, and the grooves can in turn be provided with one or more removable members such as snap rings, having an interior surface with a selected profile disposed thereon. An embodiment of the removable members can be seen as elements 51 and 61 in FIG. 2. Through this embodiment, a desired number of identical subs or other tubular segments can be produced, having grooves disposed therein, while interchangeable, removable members can be used to provide each set of grooves with a selected profile.

When a tool is lowered within the tubular string, a blade is provided in communication with the tool, the blade having a plurality of protruding members extending therefrom. The protruding members define a male profile complementary to the selected profile within the tubular string, such that when the tool is lowered such that the blade contacts the selected profile, the complementary profile will engage and lock within the selected profile, allowing the precise position of the tool in relation to the grooves within the tubular string to be determined.

In an embodiment of the invention, the blade provided to the tool can be reusable, interchangeable, machinable, and/or re-machinable, enabling complementary profiles keyed to specific selected profiles within the tubular string to be selectively provided and/or interchanged when it is desired to position a tool at one or more precise locations within the tubular string.

The blade can be secured to or otherwise placed in communication with the tool in any manner. In various embodiments of the invention, a hinged and/or pivotable arm can be provided in communication with the tool and the blade, enabling the blade to pivotably track along the interior surface of the tubular string as the tool is lowered. In a further embodiment of the invention, an anchor can be secured to the tool, a selected distance from the tool, the anchor having the blade disposed in communication therewith. When the profile on the blade engages a selected profile within the tubular string, the position of both the anchor and tool are then able to be determined.

A biasing member, such as a bow spring or other type of spring, a shear pin, or a similar member, can be provided in communication with the blade, to continuously bias the blade outward from the tool, toward the interior surface of the tubular member or tubular string. Biasing of the blade causes the blade to track along the interior surface of the tubular string while the tool is lowered, facilitating locking of the complementary profile disposed thereon with the selected profile within the tubular string.

In an embodiment of the system for positioning and cutting or perforating a tool, the tubular member, which can be part of a tubular string positioned within a wellbore, can be connected to another tubular or to a downhole tool, and the cutting or perforating tool can be selectively positioned within the tubular member to cut or perforate the another tubular or the downhole tool. In this embodiment, the downhole tool can comprise any downhole tool including a packer, a cut-to-release packer, a dual completion packer, a valve, a ball valve or ball valve assembly, a sub-surface safety valve, a flapper valve, a gas lift mandrel, a kick-off system, a shifting tool, or combinations thereof.

In an embodiment, the system for positioning and cutting or perforating a tool can comprise slips positioned about the tubular member and at least one wedge positioned about the tubular member, wherein the wedge can be adapted to move the slips radially outward with respect to the longitudinal axis of the tubular member, thereby engaging the slips against the inside surface of the wellbore or of another tubular member.

While the present invention is usable to position any tool within a tubular string, in a preferred embodiment of the invention, the cutting or perforating tool can include a torch, a cutter, or another type of cutting and/or perforating device intended to at least partially cut into a portion of the tubular string. The selected profile within the tubular string can be disposed proximate to a joint within the string, such that when the complementary profile of the blade is engaged with the selected profile, the tool is oriented to cut or perforate the tubular string at or proximate to the joint. Cutting and/or perforating a tubular at or proximate to a joint can release tensile forces from the torqued joint, facilitating removal of a severed portion of the tubing string from the wellbore.

In use, a tubular string can be provided with any number of selected profiles, which differ from one another. Prior to lowering a tool into the tubular string, the tool can be provided with a profile complementary to any of the selected profiles within the tubular string that corresponds to the location to which it is desirable to lower the tool. After the tool has been actuated, or once it is no longer desirable to retain the tool in engagement with the selected profile, the tool can be removed, such as by shearing a shear pin or other frangible member, enabling upward movement of the tool.

The present invention thereby provides systems and methods able to very accurately position a tool within a tubular string at one or more preselected locations, with greater precision than existing methods. All blades, subs, snap rings, and/or other parts used within various embodiments of the present invention can be reusable, interchangeable, machinable, and re-machinable, enabling a tubular string to be provided with any number of standardized or customized profiles, with complementary profiles to be provided to one or more tools. Further, the present systems and methods can include pre-tensioned, directionally biased members usable to selectively engage and disengage from selected locations within a tubular string.

BRIEF DESCRIPTION OF THE DRAWINGS

In the detailed description of various embodiments of the present invention presented below, reference is made to the accompanying drawings, in which.

Embodiments of the present invention are described below with reference to the listed Figures.

DETAILED DESCRIPTION OF THE EMBODIMENTS

Before explaining selected embodiments of the present invention in detail, it is to be understood that the present invention is not limited to the particular embodiments described herein and that the present invention can be practiced or carried out in various ways.

Figure 1A:
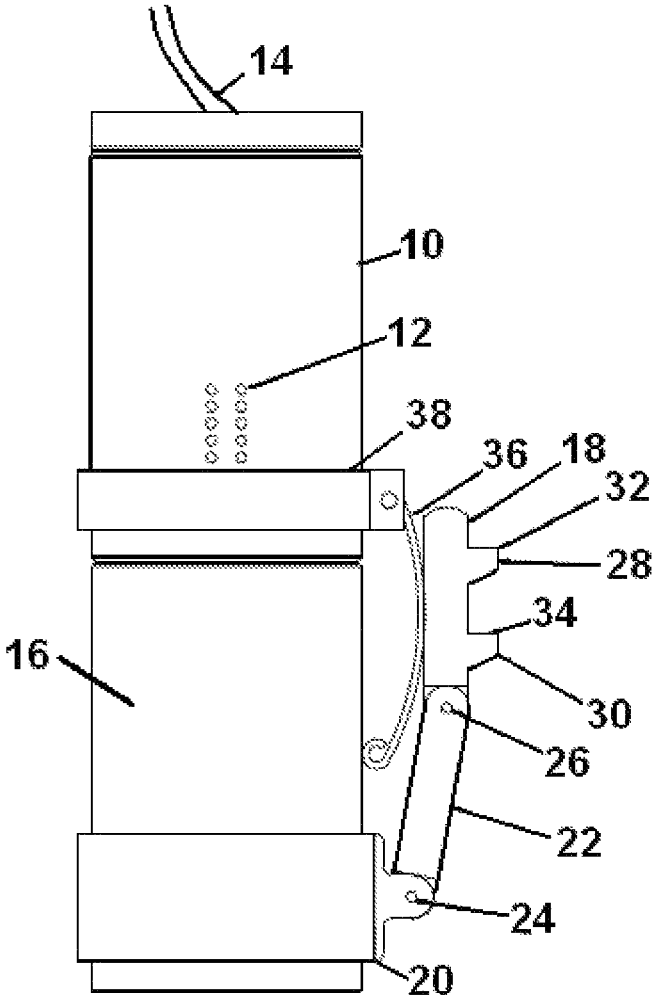
FIG. 1A depicts an embodiment of a male profile disposed in association with a tool.

Referring now to FIG. 1A, an embodiment of a portion of the present system is depicted. Specifically, FIG. 1A depicts a torch (10), having perforations (12) and/or nozzles disposed therein for providing heat, molten metal, and/or materials for cutting and/or perforating a tubular, the torch (10) being lowered using a conduit (14). While FIG. 1A depicts a torch (10), it should be understood that the present invention is usable to selectively position any type of tool within a wellbore. An exemplary torch usable with various embodiments of the present system is described in U.S. Pat. No. 6,598,679, the entirety of which is incorporated herein by reference.

In FIG. 1A, the torch (10) is shown having an anchor (16) secured thereto, in a direction downhole from the body of the torch (10). A blade (18) is provided in communication with the torch (10) through connection to a collar (20) disposed around the anchor (16). A pivotable arm (22) is shown connected to collar (12) at a first pivot point (24), and to the blade (18) at a second pivot point (26). Movement of the pivotable arm (22) enables the blade (18) to track along the interior surface of a tubular string independent of any interior features, shoulders, protrusions, restrictions, or other changes in diameter within the string.

While FIG. 1A shows the blade (18) secured to the torch (10) using the anchor (16), collar (20), and pivotable arm (22), it should be rioted that this configuration is an exemplary embodiment of the invention, and that the blade (18) can be provided in communication with the torch (10) or another tool in any manner that enables the blade (18) to contact the inner surface of the tubular string into which the torch (10) is lowered.

The blade (18) is shown having a first protrusion (28) and a second protrusion (30) disposed thereon, which together define a selected male profile, intended to engage with a complementary female profile within a tubular string, thereby enabling precise positioning of the torch (10). While only two protrusions (28, 30) are shown, the selected male profile can include any number of protruding members having any shape or spacing. The depicted first and second protrusions (28, 30) are shown having first and second no-go shoulders (32, 34), respectively, which prevent upward movement of the blade (18) after engagement of the protrusions (28, 30) within complementary female grooves having matching shoulders.

FIG. 1A further depicts a bow spring (36) attached to the torch (10) using an upper collar (38). The bow spring (36) is disposed in communication with the blade (18) to bias the blade (18) in an outward direction to cause engagement of the protrusions (30, 32) with a complementary profile within the tubular string when the torch (10) and anchor (16) have been lowered to the selected position. While the upper collar (38) is shown disposed around the body of the torch (10), the bow spring (36) or other biasing member can be attached to the anchor (16), or otherwise provided in communication with the blade (18) in a manner to bias the blade (18) in an outward direction.

Additionally, while FIG. 1A depicts the blade (18) and bow spring (36) attached to the torch (10) and anchor (16) through use of collars (20, 38), it should be understood that the depicted embodiment of the invention is an exemplary configuration, and that other attachment and/or mounting members can be used, or various elements can be directly attached to the body of a tool or anchor to be lowered.

Figure 1B:
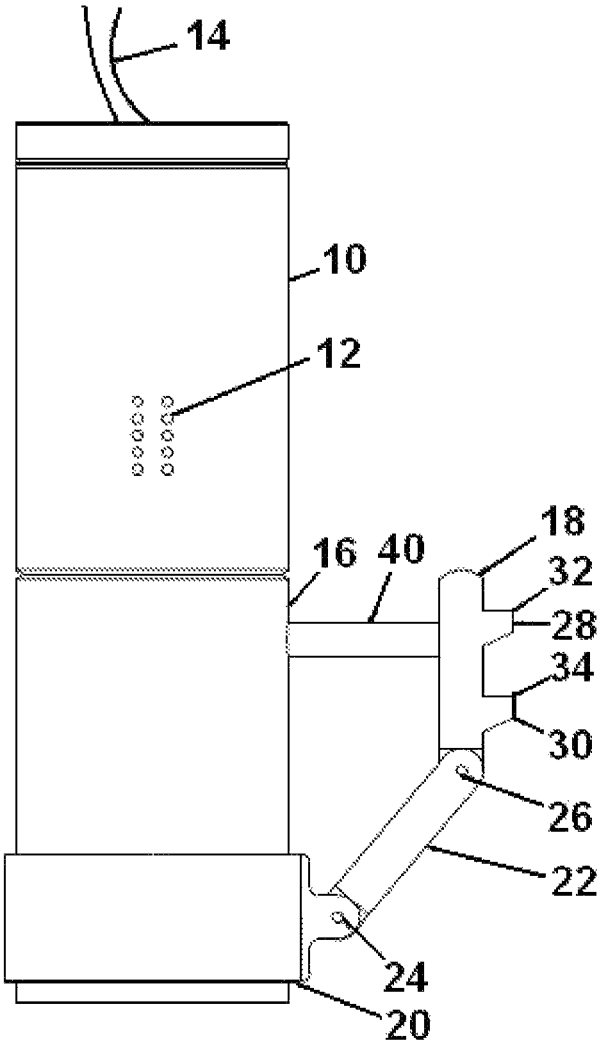
FIG. 1B depicts an alternate embodiment of the male profile and tool of FIG. 1A.

Referring now to FIG. 1B, an alternate embodiment of a portion of the present system is shown, in which a shear pin (40) is used to secure the blade (18) to the anchor (16) and bias the blade (18) in an outward direction. When it is desirable to retrieve the torch (10) and anchor (16), the shear pin (40) can be broken, enabling the blade (18) to be retracted from engagement with a complementary profile.

Figure 2:
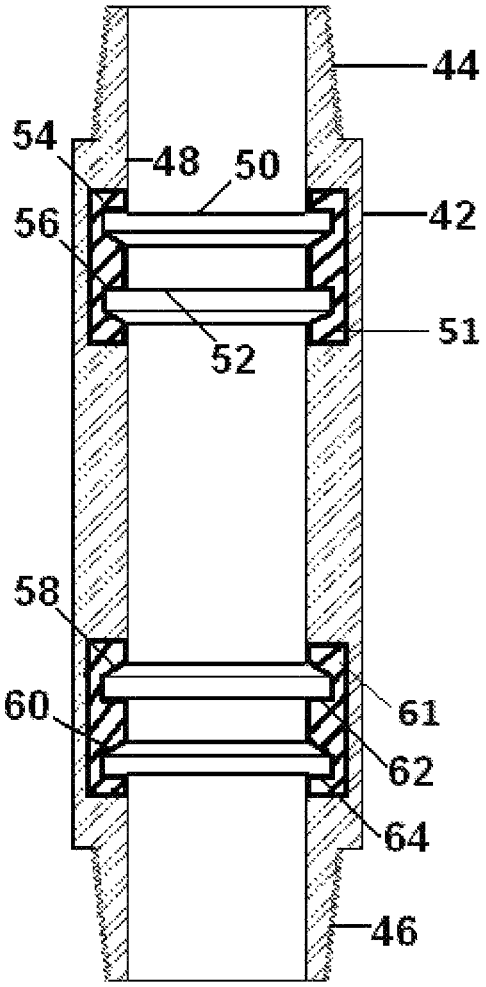
FIG. 2 depicts an embodiment of a female profile disposed within a tubular segment.

Referring now to FIG. 2, an embodiment of a portion of the present system is shown, depicting a tubular segment (42) (e.g., a tubular member) usable to position a tool having a selected profile disposed thereon. The tubular segment (42) is shown having a first end (44) and a second end (46), which are both depicted as box ends having interior threads. While FIG. 2 depicts two box ends, one or both ends (44, 46) of the tubular segment (42) can include pin ends, depending on the adjacent tubular segments intended for engagement with the depicted tubular segment (42).

The interior surface (48) of the tubular segment (42) is shown having a first groove (50) and a second groove (52) disposed therein, the grooves (50, 52) defining a selected female profile usable to engage with a complementary male profile disposed in association with a tool. The first and second grooves (50, 52) are shown having first and second no-go shoulders (54, 56) within, which prevent upward movement of an engaged tool when a complementary profile having similar shoulders is locked within the grooves (50, 52).

FIG. 2 further depicts a third groove (58) and a fourth groove (60), having no-go shoulders (62, 64) disposed therein. The third and fourth grooves (58, 60) can define a selected female profile different from that defined by the first and second grooves (50, 52), enabling the tubular segment (42) to be installed in an inverted orientation when it is desirable to enable engagement with certain selected male profiles. A complementary male profile configured to engage with a selected female profile will pass over a non-matching and/or inverted female profile.

Figure 3:
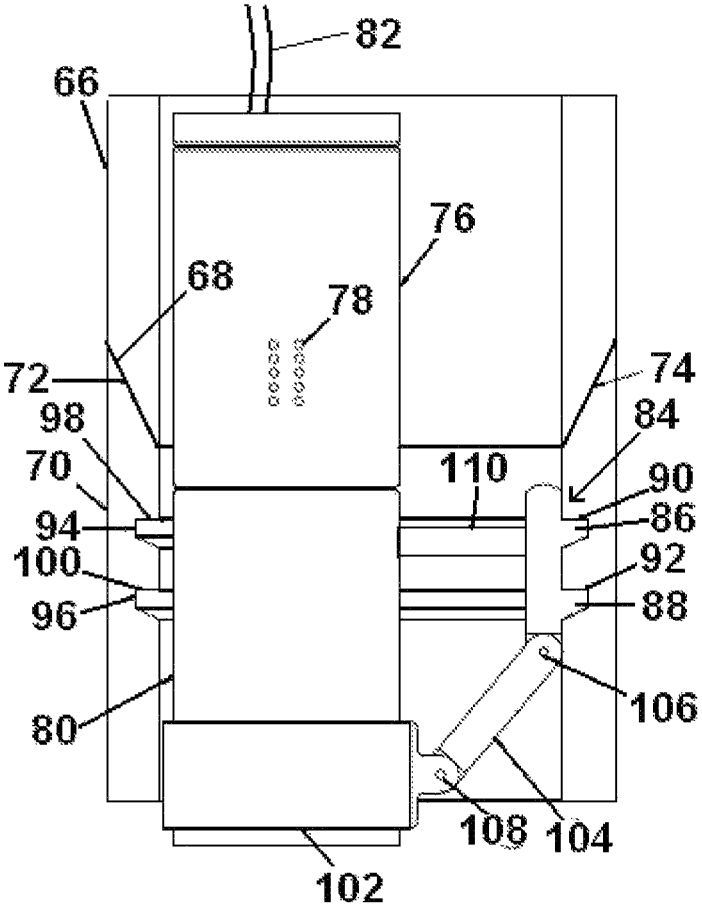
FIG. 3 depicts an embodiment of a tool in engagement with a tubular segment using an embodiment of the present system.

Referring now to FIG. 3, an embodiment of a tool in engagement at a selected location within a tubular string is shown. Specifically, FIG. 3 depicts a first tubular segment (66) having a pin end (68), engaged with a box end (72) of a second tubular segment (70). Together, when torqued, the box end (72) and pin end (68) define a joint (74), which connects the first and second tubular segments (66, 70) to form a generally seamless portion of a tubular string.

A torch (76) is shown disposed within the tubular string, having perforations and/or nozzles (78) oriented to at least partially cut and/or perforate the outer wall of the tubular string at the joint (74), such that if the size or capabilities of the torch (76) are limited by the inner diameter of the tubular string, only the pin end (68) of the first tubular segment (66) is required to be cut to release the tensile forces from the joint (74) and facilitate removal of the first tubular segment (66) and all components above.

The torch (76) is shown having an anchor (80) secured thereto, the torch (76) and anchor (80) being lowered within the tubular string via a conduit (82). The anchor (80) is shown having a blade (84) in communication therewith, the blade (84) having a first protrusion (86) and a second protrusion (88), together defining a selected male profile. The first and second protrusions (86, 88) are shown having a first no-go shoulder (90) and a second no-go shoulder (92), respectively.

The interior surface of the second tubular segment (70) is shown having a first groove (94) and a second groove (96) disposed therein, which define a selected female profile complementary to the selected male profile of the blade (84). The first and second grooves (94, 96) are provided with first and second interior no-go shoulders (98, 100).

When the torch (76) and anchor (80) are lowered to the selected position within the tubular string, the protrusions (86, 88) of the blade (84) become engaged within the grooves (94, 96) of the second tubular segment (70), with the no-go shoulders (90, 92) of the blade (84), abutting the no-go shoulders (98, 100) of the second tubular segment (70), preventing upward movement of the torch (76) and anchor (80) after engagement.

A collar (102) is shown disposed around the anchor (80), to which the blade (84) is secured, with a pivotable arm (104) disposed therebetween. The pivtoable arm (104) provides a range of motion to the blade (84) through a first pivot point (106) disposed between the pivotable arm (104) and the blade (84), and through a second pivot point (108) disposed between the pivotable arm (104) and the collar (102). It should be understood, however, that the blade (84) can be provided in communication with the torch (76) and/or the anchor (80) through any configuration, including or excluding collars and/or arms.

A shear pin (110) is further shown in communication with the anchor (80) and the blade (84), the shear pin (110) biasing the blade (84) in an outward direction such that the blade (84) tracks along the interior surface of the tubular string as the torch (76) and anchor (80) are lowered. When it is desirable to disengage the blade (84) from the second tubular segment (70), the shear pin (110) can be broken, enabling the blade (84) to pivot away from the interior surface of the second tubular segment (70), thereby disengaging the protrusions (86, 88) from the complementary grooves (94, 96).

FIG. 3 depicts the torch (76) engaging the tubular segment (70) via the blade (84), wherein the torch (76) is positioned to cut or perforate the joint (74) between tubular segments (66, 70). However, in other embodiments of the present disclosure, the positioning/cutting system can be adapted to only cut or perforate a separate tubular or a downhole tool (not shown), which is connected to or is in close proximity to the tubular segment (42) depicted in FIG. 2.

FIG. 2 depicts one embodiment of a tubular segment (42) having complementary grooves (50, 52, 58, 60) adapted to engage with the protrusions (28, 30) of the blade (18), depicted in FIG. 1A. In an embodiment, the blade (18) may engage the tubular segment (42), while the torch (10) may extend through or be positioned within another tubular or downhole tool (not shown) connected above or below the tubular segment (42). The positioning/cutting system can be configured with a predetermined or a sufficient distance between the blade protrusions (28, 30) and the torch nozzle (12), enabling the protrusions (28, 30) to connect to a tubular segment (42), while the torch (16) or the torch nozzle (12) is positioned within another tubular or downwell tool, wherein the torch is capable of cutting the another tubular or downhole tool, without cutting or perforating the tubular segment (42). In order to achieve a sufficient distance between the torch cutting nozzle (12) and the protrusions (28, 30) of the blade (18), either the torch (10), the anchor (16), the pivotable arm (22), the blade (18), or combinations thereof, can be configured to a desired size, width, length, etc. to provide the desired distance. The position of the connection collar (20), along the anchor andlor the torch (10), can also be adjusted to set the desired distance between the protrusions (28, 30) and the torch nozzle (12).

The adjustability of the distance between the protrusions (28, 30) and the torch nozzle (12) also provides the ability to cut or perforate the another tubular or the downhole tool at a desired location (i.e., a cutting zone). For example, if the distance between the grooves (50, 52) on the tubular segment (42) and the cutting zone on the another tubular or the downhole tool is known, the distance between the protrusions (28, 30) and the torch nozzle (12) can be adjusted to match it, thereby the torch nozzle (12) can be positioned to cut or perforate at the cutting zone.

The precise positioning of a cutting torch within the downhole tool or a tubular, which is selected for cutting or perforating, allows the use of a new cut-to-release packer in downwell operations, which requires precision cutting or perforating. Accordingly, this cut-to-release packer can eliminate the "dog bone" cut zone, which is presently used in typical cut-to-release packers, as the dog bone type cutting zone greatly weakens the structure of the packer and reduces its pressure rating.

In an embodiment of the system for positioning a cutting or perforating tool for cutting or perforating a tubular member or a downhole tool, a blade of the system can be attached to a tubular segment that is positioned below or connected to the bottom or the top of the selectively positioned cut-to-release packer. Then, the cutting or perforating tool, comprising nozzles (12) that have been configured at a desired distance from the blade protrusions (28, 30), can cut the cut-to-release packer at a desired location for release of the packer from the wellbore.

In an embodiment of the present disclosure, the tubular segment (42) depicted in FIG. 2, can be attached to or in close proximity to another downhole tool or a tubular (not shown), as part of a tubular string. For example, the tubular segment (42) can be connected with any downhole tool or a tubular that is selected for cutting or perforating, which can include, but is not limited to, ball valves, sub-surface safety valves, flapper valves, packers, cut-to-release packers, dual completion packers, gas lift mandrels, kickoff systems, shifting tools, and other downhole tools. It should be understood that the tubular segment (42) can be connected on either end (e.g. upwell side or downwell side) of the downhole tool or a tubular. It should be understood that the tubular member (42) can contain any number and type of groove profiles, other than the two profiles depicted in FIG. 2.

Figure 6:
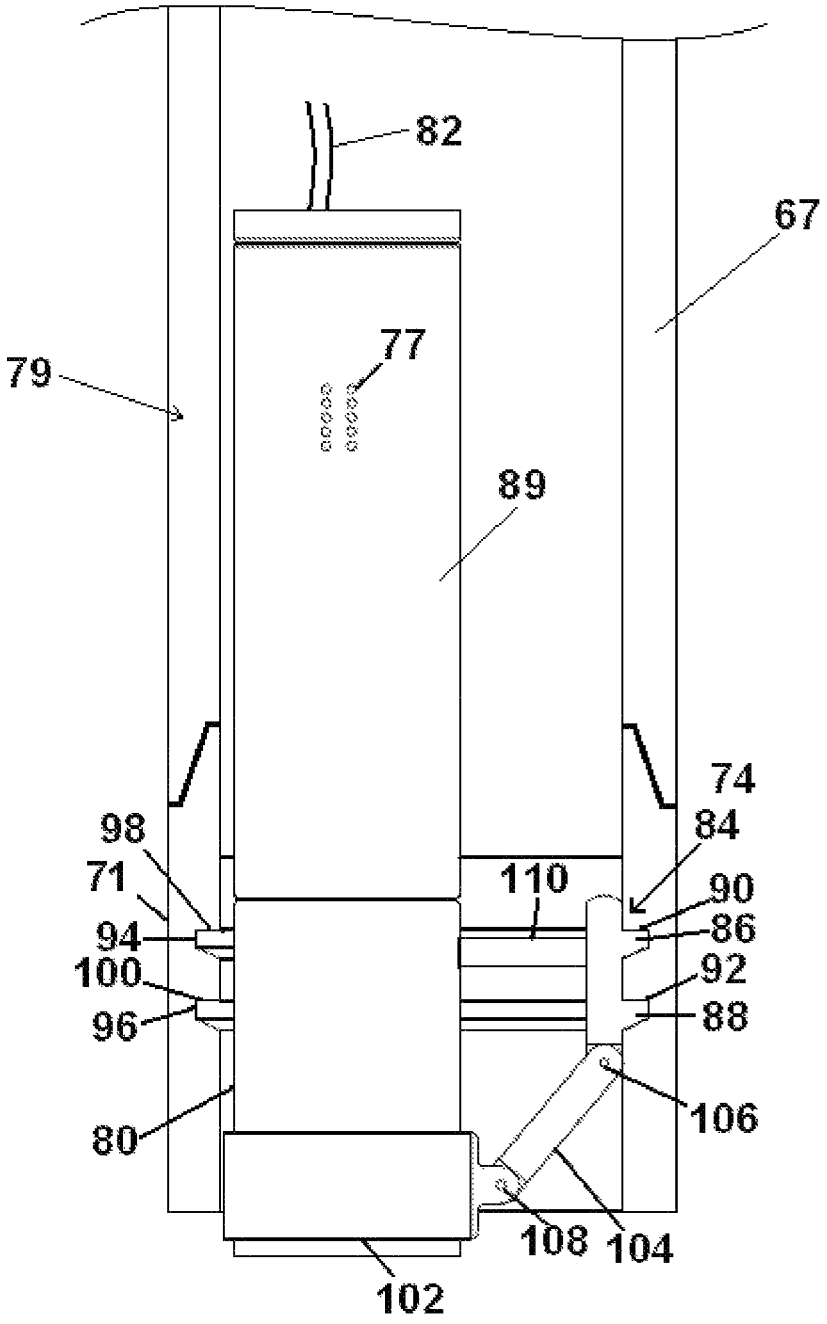
FIG. 6 depicts an embodiment of a tool in engagement with a tubular segment and adapted to cut another tubular or a downhole tool.

FIG. 6 depicts one embodiment of a tubular segment (71) being connected to a downhole tool (67), wherein the downhole tool can be a packer, a cut-to-release packer, a dual completion packer, a ball valve or valve assembly, a sub-surface safety valve, a flapper valve, a gas lift mandrel, a kickoff system, a shifting tool, and any other downhole tool that can be selectively positioned above the tubular segment (71). As shown, the torch (89) comprises a longer body, which enables the torch (89) to extend upwardly into the downhole tool (67) to cut the downhole tool at a designated cutting zone (79), with great precision and accuracy. As can be seen, the torch nozzles (77) are positioned adjacent to the cutting zone (79). Although FIG. 6 depicts a positioning/cutting system having an elongated torch (89), other embodiments can comprise a blade, an anchor, a pivotable arm, or combinations thereof, which can be configured to a desired size, width, length, and/or other dimensions, to provide the desired positioning of the nozzles (77) or other cutting elements.

In another embodiment of the present disclosure, the positioning/cutting system can be configured whereby the torch nozzle (12) can cut or perforate the tubular segment (42), without cutting or perforating the another tubular or downhole tool. This configuration enables a tubular string to be cut at the tubular segment (42), without damaging other tubulars or downhole tools, which can then be retrieved to the surface.

Figure 4:
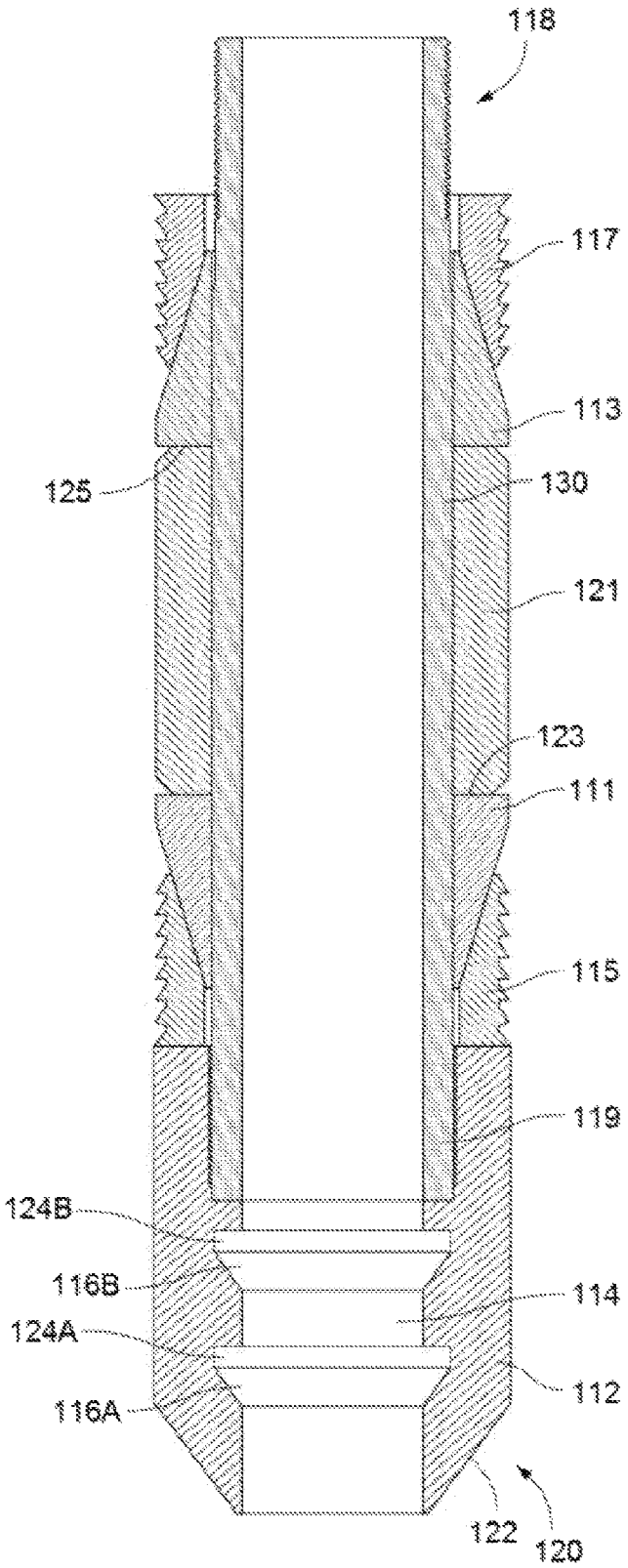
FIG. 4 depicts a side cross-sectional view of an embodiment of a positioning apparatus usable within the scope of the present disclosure.
Figure 5:
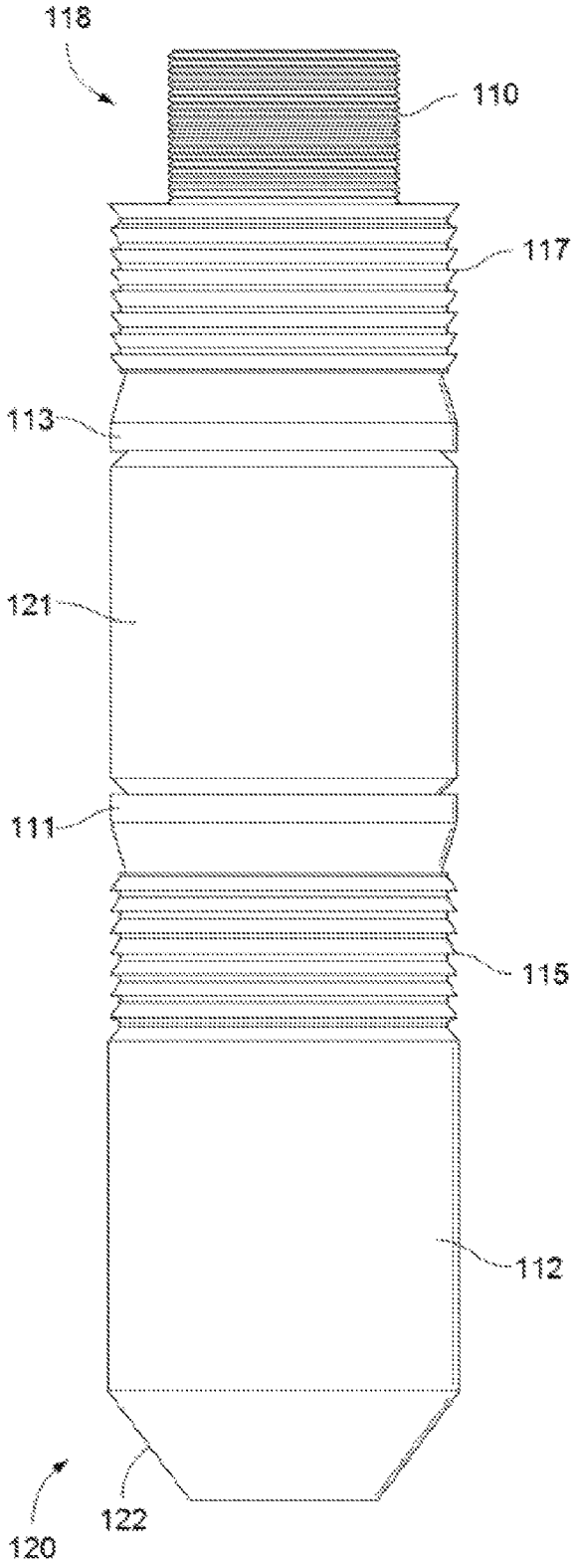
FIG. 5 depicts a side view of the positioning apparatus of FIG. 4.

The present invention further relates to a system usable to selectively position a tubular segment or a tool deployed with anchoring-capable features within a wellbore. The tubular segments and tools can include, but are not limited to, tubular segments and downhole tools, as described above and including a packer, a cut-to-release packer, a dual completion packer, a ball valve or valve assembly, a sub-surface safety valve, a flapper valve, a gas lift mandrel, a kickoff system, a shifting tool. Furthermore, embodiments of the present positioning apparatus can include members for mechanical, magnetic and/or chemical fixation to a structural member. When utilizing mechanical fixation, as shown in FIGS. 4 and 5, a wedging action, resulting from a tensile or compressive force application to a slip and cone assembly, can be used. As a load is applied, typically with an oilfield setting tool, the slips can be forced over a cone section, creating high compressive loading and friction between the target pipe inside diameter and the rigid cone of the anchor apparatus. In a magnetically fixed condition, a high strength magnet can be slid into a position, such that close contact can enable high magnetic affinity and subsequent fixation. Chemical fixation can take the form of a firm or semi-firm glue action, a secreted fast setting polymer, or an epoxy compatible with the wellbore fluid.

FIGS. 4 and 5 depict an embodiment of a positioning apparatus that includes a structural mandrel (130) supporting a cone (112), which contains an inside diameter profile (114) with a groove or a plurality of grooves (116A, 116B) and/or a slot, such as the grooves (50, 52) or grooves (58, 60), depicted in FIGS. 2 and 3 and described above, in which a complementary projected profile, plurality of projected profiles, and/or a slot acquiring member of a tool or similar component may reside. While FIGS. 4 and 5 depict grooves (116A, 116B) for mechanical engagement with complementary protrusions of an apparatus and/or tubular string, it should be understood that in various embodiments, the grooves (116A, 116B), and/or the complementary protrusions for engagement therewith, can include one or more magnets for providing magnetic adhesion, and/or one or more chemicals (e.g., adhesives, epoxies, or similar substances) to provide a chemical adhesion. In further embodiments, chemical and/or magnetic adhesion can be used in place of any mechanical engagement, and use of grooves (116A, 116B) can be omitted.

In the depicted embodiment, the mandrel (130) is shown having first and second cone and/or wedge-shaped protrusions (111, 113), which can provide engagement with the cone (112) through compression of slips (115, 117), attached thereto. A threaded connection (119), shown in FIG. 4, can be usable to further secure the mandrel (130) to the cone (112). A sealing section (121) is shown disposed between the cone and/or wedge shaped protrusions (111, 113), both of which are further shown having generally perpendicular shoulders (123, 125), that can abut the sealing section (121), for preventing undesired movement of the mandrel (130) and/or the cone (12). Similar to the methods of engagement using the grooves (116A, 116B), as described above, engagement between the cone and/or wedge shaped protrusions (111, 113) and the slips (115, 117) can include magnetic and/or chemical fixation, in addition to or in lieu of the mechanical engagement between the protrusions (111, 113) and slips (115, 117).

A portion of the positioning apparatus, usable to position a tool having a selected profile disposed thereon, is designed. The apparatus tubular segment, having a first end (118) and a second end (120) (e.g., a top and/or uphole end and a bottom and/or downhole end, respectively), can include a chamfer (122) for the complementary tool string to align and penetrate into or through the positioning apparatus.

The interior surface of the positioning apparatus thus defines a selected female profile (114), which can be usable to engage with a complementary male profile disposed in association with a tool. In an embodiment, a profile, having no-go shoulders (124A, 124B) within that prevent upward movement of an engaged tool when a complementary profile, having similar shoulders, is locked within the grooves, can be used.

The arrangement of grooves can define and/or include multiple profiles for enabling the anchor or similar apparatus to be installed in an inverted orientation, or to pass through the apparatus for positioning elsewhere, when it is desirable to enable engagement with certain selected male profiles. A complementary male profile, configured to engage with a selected female profile, will pass over a non-matching and/or inverted female profile.

When a torch or similar apparatus, with a latching anchor tool string, is lowered to the selected position within the wellbore-set positioning apparatus, the protrusions of the profile matching latch of the torch and/or anchor become engaged within the positioning apparatus grooves (116A, 116B).

Once operations concerning the deployed tool string are completed, the tool string can be removed from the positioning apparatus by shearing a pin, overcoming a locking spring force, or other release techniques known in the art, thereby removing the protrusions from the grooves (116A, 116B).

Additionally, once the positioning apparatus are completed following tool string removal, the mechanical, magnetic, and/or chemical fixation method can be reversed, utilizing means common to those fixation techniques as taught in prior known art procedures.

In an embodiment of the present invention, the positioning apparatus can include the ability to and can be usable for, or can include the method of, initially, or subsequent to prior operations, setting an effective apparatus within the inside diameter of the mandrel. Such additional components can be a smaller diameter plug for sealing (thus conveying an effective smaller plug in likely restricted access channels), installing sensor gauges for well monitoring, inserting valve components for flow control, inserting a flapper valve arrangement or other oil well control improvements requiring anchoring, clocking and an advantage of reduced diameter passage. All systems can remain permanent or retrievable as designed or as taught conventionally.

While various embodiments of the present invention have been described with emphasis, it should be understood that within the scope of the appended claims, the present invention might be practiced other than as specifically described herein.

What is claimed is:

1. A system for positioning a cutting or perforating tool within a tubular member, the system comprising:

a collar configured to directly attach to the cutting or perforating tool;

a first blade attached to the collar, wherein the first blade comprises a first plurality of protruding members, and wherein the first plurality of protruding members define a first complementary profile configured to lock only within a first selected profile disposed on or within an interior surface of the tubular member; and a biasing member in communication with the first blade, wherein the biasing member continually biases the first blade toward the interior surface of the tubular member to cause locking of the first complementary profile within the first selected profile, wherein the cutting or perforating tool comprises a torch, a cutter, a perforating device, or combinations thereof, and wherein the cutting or perforating tool is selectively positioned to cut or perforate the tubular member, another tubular connected to the tubular member, a downhole tool, or combinations thereof.

2. The system of claim 1, wherein the another tubular or the downhole tool comprises a packer, a cut-to-release packer, a dual completion packer, a valve, a ball valve, a sub-surface safety valve, a flapper valve, a gas lift mandrel, a kickoff system, a shifting tool, or combinations thereof.

3. The system of claim 1, wherein the tubular member is part of a tubular string positioned within a wellbore.

4. The system of claim 3, wherein the first selected profile is disposed proximate to a joint within the tubular string, and wherein the cutting or perforating tool is oriented to cut or perforate the tubular string at the joint or proximate to the joint when the first complementary profile is locked within the first selected profile.

5. The system of claim 1, wherein the first selected profile comprises a set of grooves.

6. The system of claim 1, further comprising a removable member disposed on and removable from the interior surface of the tubular member, wherein the removable member comprises the first selected profile.

7. The system of claim 1, further comprising:

an additional blade interchangeable with the first blade, wherein the additional blade comprises an additional plurality of protruding members, wherein the additional plurality of protruding members define an additional complementary profile configured to lock only within an additional selected profile, wherein an additional selected spacing of said additional complimentary profile is different from the first complimentary profile, and wherein the additional blade bypasses the first selected profile without locking within the first selected profile as the blade moves along an interior surface of a tubular member.

8. The system of claim 1, wherein a location of the attachment of the collar to the cutting or perforating tool may be adjusted.

9. The system of claim 1, further comprising:

a plurality of slips positioned about the tubular; and at least one wedge positioned about the tubular member, wherein the at least one wedge is adapted to move the plurality of slips radially outward with respect to a longitudinal axis of the tubular member, thereby engaging the plurality of slips against an inside surface of a wellbore or an inside surface of the another tubular member.

10. The system of claim 1, wherein the locking of the first complementary profile within the first selected profile anchors the cutting or perforating tool at a desired position, prevents movement of the cutting or perforating tool, or combinations thereof.

11. A method for positioning a cutting or perforating tool within a tubular member of a wellbore, the method comprising the steps of:

securing a collar directly to the cutting or perforating tool, wherein the collar is directly or indirectly attached to a first blade comprising a first plurality of protruding members that define a first complementary profile configured to lock within a first selected profile disposed within the tubular member;

lowering the cutting or perforating tool and the secured collar into the tubular member;

biasing the first blade in an outward direction from the cutting or perforating tool while the cutting or perforating tool is lowered to a location proximate to the first selected profile;

locking the first complementary profile of the first blade within the first selected profile; and actuating the cutting or perforating tool to cut or perforate at least a portion of the tubular member, another tubular connected to the tubular member, a downhole tool, or combinations thereof.

12. The method of claim 11, wherein the cutting or perforating tool comprises a torch, a cutter, a perforating device, or combinations thereof.

13. The method of claim 11, further comprising, before locking into the first selected profile, sliding the first blade passed another selected profile without locking the first blade into the another selected profile.

14. The method of claim 13, further comprising retrieving the cutting or perforating tool from the wellbore; and replacing the first blade with an additional blade, wherein the additional blade comprises an additional plurality of protruding members, wherein the additional plurality of protruding members define an additional complementary profile configured to lock only within the second complementary profile, and wherein the second complementary profile is different from the first complimentary profile.

15. The method of claim 11, further comprising the step of securing a removable member to an interior surface of the tubular member, wherein the removable member comprises the first selected profile of first plurality of grooves disposed thereon.

16. The method of claim 11, further comprising the steps of:

providing a plurality of slips positioned about the tubular member;

providing at least one wedge positioned about the tubular member;

engaging the at least one wedge with the plurality of slips;

moving the plurality of slips radially outward with respect to a longitudinal axis of the tubular member; and engaging the plurality of slips with an inside surface of a wellbore or another tubular member, thereby locking the tubular member in a position against the inside surface of the wellbore or the another tubular member.

17. The method of claim 11, further comprising clocking in a desired direction to position the cutting or perforating tool at a desired angle from an original position.

18. The method of claim 11, further comprising anchoring the cutting or perforating tool, preventing movement of the cutting or perforating tool, or combinations thereof.

19. A system for positioning a cutting or perforating tool within a tubular member for cutting or perforating, the system comprising:

a mounting member configured to directly attach to a cutting or perforating tool, wherein the mounting member is positioned concentrically about the cutting or perforating tool, and wherein the cutting or perforating tool comprises a torch, a cutter, a perforating device, or combinations thereof;

a blade directly or indirectly attached to the mounting member, wherein the blade comprises a plurality of protruding members that define a first selected profile configured to lock within a plurality of grooves defining a first complementary profile, and wherein the plurality of grooves are positioned within a wellbore; and a biasing member in communication with the blade, wherein the biasing member continually biases the blade away from the cutting or perforating tool for engaging the plurality of protruding members with the plurality of grooves, wherein the tubular member is connectable to another tubular or a downhole tool, and wherein the cutting or perforating tool is adapted to cut or perforate the another tubular or the downhole tool when engaged with the tubular member.

20. The system of claim 19, wherein the another tubular or the downhole tool comprises a packer, a cut-to-release packer, a dual completion packer, a valve, a ball valve, a sub-surface safety valve, a flapper valve, a gas lift mandrel, a kickoff system, a shifting tool, or combinations thereof.

21. The system of claim 19, wherein the tubular member is part of a tubular string positioned within a wellbore, wherein the cutting or perforating tool is positioned within the tubular string, wherein the cutting or perforating tool is adapted to cut or perforate the tubular string.

22. The system of claim 19, wherein the position of the mounting member is fixedly adjustable along the length of the cutting or perforating tool.

23. The system of claim 19, wherein the biasing member biases the blade in a desired direction to position the cutting or perforating tool at a desired angle from an original position.

24. The system of claim 19, further comprising:

at least one slip positioned about the tubular member; and at least one wedge positioned about the tubular member, wherein the at least one wedge is adapted to move the at least one slip radially outward with respect to a longitudinal axis of the tubular member, thereby engaging the at least one slip against an inside surface of a wellbore or an inside surface of another tubular member.

* * * * *